United States Patent [19]

Young

[11] 4,104,948

[45] Aug. 8, 1978

[54] FIPPLE BLOCK FOR MUSICAL RECORDERS

[76] Inventor: George Bartholomew Young, 113 Forest Ave., Cranford, N.J. 07016

[21] Appl. No.: 799,387

[22] Filed: May 23, 1977

[51] Int. Cl.[2] ..... G10D 7/02

[52] U.S. Cl. ..... 84/380 C

[58] Field of Search ..... 84/330, 380 C, 384, 84/380 R

[56] References Cited

U.S. PATENT DOCUMENTS

| | | | |
|---|---|---|---|
| 2,195,992 | 4/1940 | Mausolf | 84/380 C |
| 2,944,459 | 7/1960 | Simmonds | 84/380 C |
| 3,011,382 | 12/1961 | Kim | 84/384 |
| 3,308,707 | 3/1967 | Kelischek | 84/330 X |

*Primary Examiner*—Lawrence R. Franklin

*Attorney, Agent, or Firm*—Lerner, David, Littenberg & Samuel

[57] ABSTRACT

An improved fipple block is provided for use in connection with a wind instrument, such as a bass recorder, having a hollow tube, a fipple lip, and a fipple opening. The fipple block is formed from a solid mass of material having a substantially cylindrical exterior surface and configuration. In one embodiment, a first section of the fipple block has a larger outer diameter than a second and third section, so that the second and third sections may be inserted within the hollow tube of the wind instrument, with the first section protruding from the end of the hollow tube. The first section includes a first passageway formed therein, and it is directed at right angles to the cylindrical exterior surface of the block and is adapted to receive a mouthpiece. In addition, the second and third sections have second and third passageways, respectively. The first, second, and third passageways are connected and define a continuous passageway from the mouthpiece to the fipple opening for the passage of air which strikes the fipple lip and causes sound waves to be produced in the hollow tube of the wind instrument.

4 Claims, 4 Drawing Figures

FIPPLE BLOCK FOR MUSICAL RECORDERS

FIELD OF THE INVENTION

The present invention relates generally to musical instruments, and specifically to an improved fipple block for wind instruments, in which the fipple block is replaceable and interchangeable with different instruments and is also side blown having a narrow and defined air passageway which enhances the responsiveness of the instrument.

BACKGROUND OF THE INVENTION

Fipple blocks for wind instruments are well known and typically include a flue and a lip-stopping end. In such wind instruments, air is blown into the mouthpiece and passes through the fipple block and strikes a flat, sharp lip, the fipple lip, and produces the sound waves within the body of the instrument.

Typically, the fipple blocks are fixedly mounted within the wind instrument and cannot be removed therefrom. In one well-known arrangement, referred to as the Indian Shepherd's pipe, the fipple block is fixedly mounted within the hollow body of the instrument and is end blown. However, such an arrangement would not be acceptable for some recorders, such as bass or great-bass recorders, since they are too long to be blown from the end and must be side blown.

Another form of the well-known Shepherd's pipe also includes a fipple block fixedly mounted therein. In this arrangement, the pipe is side blown, and the air enters a large chamber or wind chest before passing through the fipple block. As there is turbulence of the air flow in the relatively large chamber, and as there is a greater air mass to control, the instrument is not highly responsive.

Broadly, it is an object of the present invention to provide an improved fipple block which overcomes one or more of the foregoing drawbacks. Specifically, it is within the contemplation of the present invention to provide an improved fipple block which is removable and replaceable, and which is interchangeable on a number of different wind instruments having the same bore diameter.

It is a further object of the present invention to provide an improved fipple block which is side blown and which provides a narrow and defined air passageway which enhances the responsiveness of the instrument.

SUMMARY OF THE INVENTION

Briefly, in accordance with the principles of the present invention, an improved fipple block is provided for use in connection with a wind instrument, wherein the wind instrument includes a hollow tube, a fipple lip, and a fipple opening. The fipple block is formed from an integral or solid mass of material, such as wood or plastic, having a substantially cylindrical exterior surface and configuration. In one embodiment, the fipple block includes first, second, and third sections, with the first section having a larger outer diameter than the second and third sections, and the second and third sections have substantially equal outer diameters. In this manner, the second and third sections of the fipple block may be inserted into the hollow tube of the instrument, with the first section protruding from or extending from the end of the hollow tube.

The first section is provided with a first passageway formed therein which is directed at right angles to the cylindrical exterior surface of the fipple block and is adapted to receive a mouthpiece. The second section functions as a seal for the fipple block relative to the hollow body of the instrument and includes a second passageway extending therethrough. In addition, the third section includes a third passageway extending therethrough and is adapted to terminate at the fipple opening when the fipple block is inserted within the hollow body of the instrument. The third passageway terminates at a point on the cylindrical exterior surface which is diametrically opposed to the point at which the first passageway meets the cylindrical exterior surface.

The first, second, and third passageways are connected and define a continuous passageway from the mouthpiece to the fipple opening for the passage of air which strikes the fipple lip and causes sound waves to be produced in the hollow body of the wind instrument.

In a second embodiment, the first section is omitted, and the second passageway within the second section is formed at right angles to the cylindrical exterior surface of the fipple block and is adapted to receive the mouthpiece. In this embodiment, the hollow body of the instrument is provided with an opening which is adapted to line up with the passageway in the second section. The mouthpiece is inserted through the opening of the hollow body and into the fipple block to hold the fipple block in a fixed position relative to the hollow body of the wind instrument.

Advantageously, the improved fipple block of the present invention is removable and replaceable, so that the entire wind instrument does not have to be discarded when the fipple block becomes worn or inoperative due to misuse. In addition, the fipple block of the present invention can be inserted in the hollow body of a number of different wind instruments and thereby reduces the cost of having a family of wind instruments. Moreover, the fipple block of the present invention is side blown, so that on various wind instruments which are relatively long, such as bass recorders, the instrument is easier to play. Finally, the fipple block of the present invention is provided with a narrow and defined air passageway which increases the responsiveness of the instrument, as there is less of an air mass to control, such as in those wind instruments having a wind chest or chamber between the mouthpiece and the fipple block.

BRIEF DESCRIPTION OF THE DRAWINGS

Further objects, features, and advantages of the present invention will become apparent upon the consideration of the following detailed description of presently-preferred embodiments when taken in conjunction with the accompanying drawing, wherein.

DETAILED DISCUSSION OF PREFERRED EMBODIMENTS OF THE INVENTION

Figure 1:
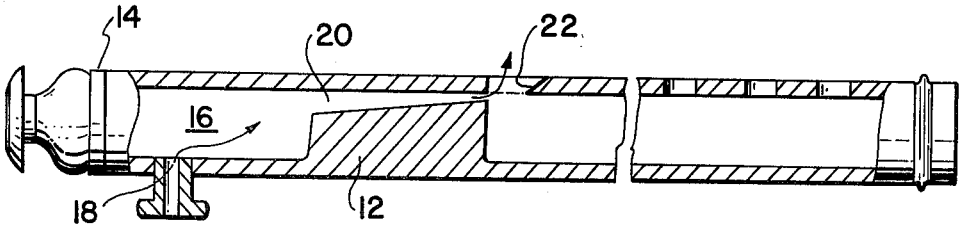
FIG. 1 PRIOR ART
FIGS. 1 and 2 are cross-sectional views of prior art wind instruments, commonly referred to as Indian Shepherd's pipes.
Figure 2:
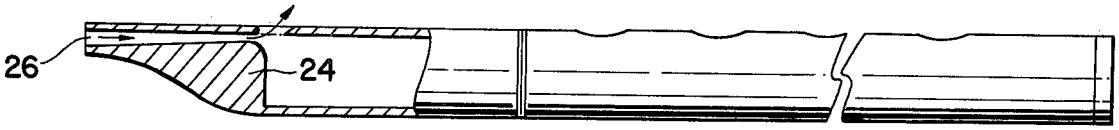
FIG. 2 PRIOR ART

Referring to FIGS. 1 and 2, they illustrate prior art arrangements of wind instruments having fipple blocks fixedly mounted within the body of the instrument and which are not replaceable or interchangeable. In addition, in the FIG. 1 arrangement, the fipple block 12 cooperates with an end plug 14 to define a chamber or wind chest 16. The air enters through a mouthpiece 18 and passes through chamber 16 and an air passageway 20 and then strikes fipple lip 22. Such a wind instrument has a reduced responsiveness because of the greater air mass within chamber 16 which must be controlled and because of the increased turbulence of air flow within chamber 16. In the FIG. 2 arrangement, there is shown another form of a Shepherd's pipe which includes a fipple block 24 and is end blown at 26. However, in some wind instruments, such as certain types of bass recorders, the instrument is too long to be blown from the end. Accordingly, the prior art arrangement of FIG. 2 would not be suitable for wind instruments of such length.

Figure 3:
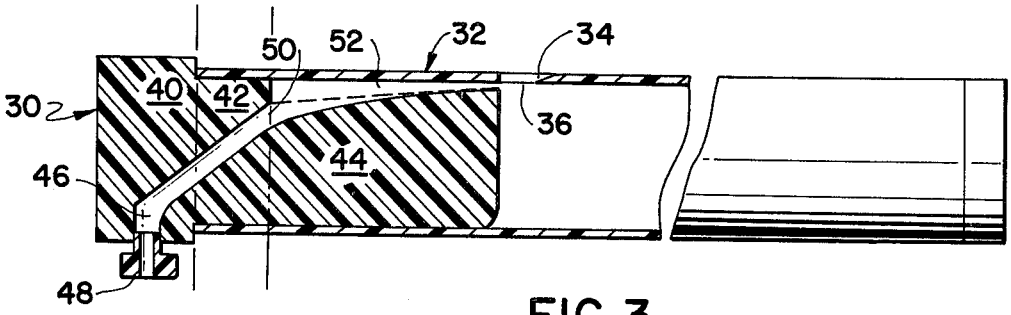
FIG. 3 is a cross-sectional view of an improved fipple block embodying the principles of the present invention illustrated being inserted within the hollow body of a wind instrument.

Turning now to FIG. 3, there is shown one embodiment 30 of an improved fipple block embodying the principles of the present invention. The fipple block 30 is shown inserted within the hollow body 32 of a wind instrument, with the hollow body 32 having a fipple lip 34 and a fipple opening 36. The fipple block 30 is preferably formed from an integral or solid mass of material, which can be wood or molded plastic or any similar material. The exterior surface of fipple block 30 has a substantially cylindrical configuration.

For ease of consideration, the fipple block 30 may be divided into sections 40, 42, and 44. In the preferred embodiment, these three sections are integrally formed from a single mass of material. Section 40 has a larger outer diameter than sections 42 and 44, whereas sections 42 and 44 have substantially equal diameters. In this manner, sections 42 and 44 may be inserted within the hollow body 32 of the wind instrument, with section 40 extending from or protruding from the end of the hollow 32.

Section 40, which protrudes from the end of hollow body 32, is provided with a passageway 46 formed therein which, at its exterior end, is formed at right angles to the exterior surface of the fipple block. The exterior end of passageway 46 is adapted to receive a mouthpiece 48 and thereby provides an arrangement whereby the wind instrument may be side blown through mouthpiece 48.

Section 42 functions as a seal for the fipple block 30 for sealing the fipple block relative to the hollow body 32 of the instrument. In addition, section 42 is provided with a passageway 50 extending therethrough for the passage of air from passageway 46.

Section 44 of fipple block 30 includes a passageway 52 extending therethrough which is defined by the interior wall of hollow body 32 and a portion removed from the solid mass of fipple block 30. When fipple block 30 is inserted within hollow body 32, passageway 52 is adapted to terminate adjacent fipple opening 36, as shown. It should be noted that in the preferred embodiment, the termination of passageway 52 is at a point on the cylindrical exterior surface of the block 30 which is diametrically opposed to the point at which passageway 46 meets the exterior surface.

The passageways 46, 50, and 52 are connected and define a continuous air passageway extending from mouthpiece 48 to fipple opening 36. Accordingly, as air enters mouthpiece 48, it passes through the continuous passageways 46, 50, and 52 and strikes fipple lip 34, causing the desired sound waves to be produced in the hollow body 32 of the wind instrument.

Figure 4:
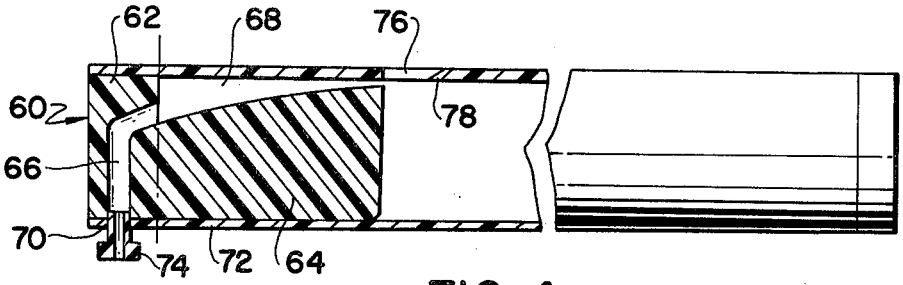
FIG. 4 is a cross-sectional view of a modified form of a fipple block embodying the principles of the present invention.

Turning now to FIG. 4, there is shown another embodiment of a fipple block embodying the principles of the present invention. In this embodiment, external section 40 of the fipple block is eliminated. More particularly, fipple block 60 includes sections 62 and 64 having passageways 66 and 68, respectively, formed in these sections. In addition, an opening 70 is formed in the barrel 72 of the wind instrument which is adapted to be in alignment with passageway 66. A mouthpiece 74 is inserted through opening 70 and into passageway 66, and it not only acts as a mouthpiece, but also functions to hold fipple block 60 in a fixed position relative to barrel 72. In this embodiment, passageways 66 and 68 are connected and define a continuous air pasageway from the mouthpiece 74 to the fipple opening 76 for the passage of air which strikes the fipple lip 78 and causes the desired sound waves to be produced in the hollow body 72 of the wind instrument.

In view of the foregoing, it will be apparent that an improved fipple block has been provided which is removable from the wind instrument so that it can be replaced when inoperable or interchanged with the bodies of other wind instruments and thereby reducing the cost of having a family of wind instruments. In addition, the fipple block is side blown so that wind instruments, such as pass recorders, which are relatively long, are more easily handled and played by students. Finally, the improved fipple block of the present invention includes a narrow and defined air passageway which enhances the responsiveness of the instrument, since it avoids the use of a large chamber or wind chest which has a greater air mass to control and which is subject to turbulence of air flow.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A fipple block for use in connection with a wind instrument, said wind instrument including a hollow body, a fipple lip, and a fipple opening, said fipple block being an integral mass of material having a substantially cylindrical exterior surface, said fipple block including first, second, and third sections, said first section having a larger outer diameter than said second and third sections, said first section having a first passageway formed therein and directed at a right angle to said cylindrical exterior surface of said fipple block and adapted to receive a mouthpiece, said second section having a second passageway extending therethrough, said third section including a hollowed-out portion so that when said fipple block is inserted within a hollow body of a wind instrument, there is defined a third passageway which is adapted to terminate at said fipple opening, said first, second, and third passageways being connected and defining a continuous passageway from said mouthpiece to said fipple opening for the passage of air which operates to strike said fipple lip and cause sound waves to be produced in the hollow body of the wind instrument.

2. A fipple block in accordance with claim 1 wherein said second and third sections have substantially equal diameters and are adapted to be inserted within the hollow body of a wind instrument, with said first section adapted to protrude from the end of said hollow body.

3. The fipple block of claim 1 wherein said third passageway terminates at a point on said cylindrical exterior surface which is diametrically opposed to the point at which said first passageway terminates on said cylindrical exterior surface.

4. A fipple block for use in connection with a wind instrument, said wind instrument including a hollow body, a fipple lip, and a fipple opening, said fipple block being an integral mass of material having a substantially cylindrical exterior surface, said fipple block including first and second sections, said first and second sections having substantially equal diameters and constructed to be inserted within said hollow body, said first section having a first passageway formed therein and directed at a right angle to said cylindrical exterior surface of said fipple block and adapted to receive a mouthpiece which extends through an opening of said hollow body, said second secton having a second passageway extending therethrough and adapted to terminate at said fipple opening, said first and second passageways being connected and defining a continuous passageway from said mouthpiece to said fipple opening for the passage of air which strikes said fipple lip and causes sound waves to be produced in the hollow body of said wind instrument.

* * * * *

UNITED STATES PATENT AND TRADEMARK OFFICE

CERTIFICATE OF CORRECTION

PATENT NO. : 4,104,948

DATED : August 8, 1978

INVENTOR(S) : George Bartholomew Young

It is certified that error appears in the above-identified patent and that said Letters Patent are hereby corrected as shown below:

Column 4, line 33, the word "pass" should read -- bass --.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*